US012704120B2

(12) United States Patent
Müller et al.

(10) Patent No.: US 12,704,120 B2
(45) Date of Patent: Aug. 11, 2026

(54) MONITORING METHOD FOR MONITORING THE OPERATION OF A DOSING PUMP AND DOSING PUMP SYSTEM

(71) Applicant: GRUNDFOS HOLDING A/S, Bjerringbro (DK)

(72) Inventors: Klaus Müller, Karlsruhe (DE); Valeri Kechler, Pforzheim (DE)

(73) Assignee: GRUNDFOS HOLDING A/S, Bjerringbro (DK)

( * ) Notice: Subject to any disclaimer, the term of this patent is extended or adjusted under 35 U.S.C. 154(b) by 442 days.

(21) Appl. No.: 17/848,477

(22) Filed: Jun. 24, 2022

(65) Prior Publication Data

US 2022/0412334 A1 Dec. 29, 2022

(30) Foreign Application Priority Data

Jun. 25, 2021 (EP) ..... 21181652

(51) Int. Cl.
*F04B 43/00* (2006.01)
*F04B 43/04* (2006.01)
(Continued)

(52) U.S. Cl.
CPC ..... *F04B 43/0081* (2013.01); *F04B 43/04* (2013.01); *F04B 49/06* (2013.01);
(Continued)

(58) Field of Classification Search
CPC ..... F04B 13/00; F04B 43/0081; F04B 43/02; F04B 43/04; F04B 49/06; F04B 49/065;
(Continued)

(56) References Cited

U.S. PATENT DOCUMENTS 5,201,636 A * 4/1993 Mikulski ..... F04B 49/10 417/18
2004/0167738 A1 8/2004 Miller
(Continued)

FOREIGN PATENT DOCUMENTS

CN 102859196 A 1/2013
CN 105492767 A 4/2016
(Continued)

*Primary Examiner* — Charles G Freay
*Assistant Examiner* — Joseph S. Herrmann
(74) *Attorney, Agent, or Firm* — McGlew and Tuttle, P.C.

(57) ABSTRACT

A monitoring method and dosing pump system monitor operation of a dosing pump including a dosing chamber (2), a displacement element (4) and an electric drive (12). A position (S) of the displacement element and a pressure (P) inside the dosing chamber are continuously recorded as a curve in a pressure-stroke diagram. The method includes monitoring at least one characteristic portion (36, 38, 40, 42, B, C) of the curve in the pressure-stroke diagram by detecting a possible shift (A) of the characteristic portion over several strokes. The method further includes one or both of: adjusting a control of the electric drive based on the detected shift; and determining a trend of the shift over several strokes of the displacement element and determining based on the trend whether and/or when the shift will reach a predefined limit. A dosing pump system with the dosing pump execute the method.

20 Claims, 5 Drawing Sheets

(51) Int. Cl.

| | |
|---|---|
| ***F04B 49/06*** | (2006.01) |
| *F04B 13/00* | (2006.01) |
| *F04B 43/02* | (2006.01) |
| *F04B 51/00* | (2006.01) |

(52) U.S. Cl.
CPC ..... *F04B 13/00* (2013.01); *F04B 43/02* (2013.01); *F04B 51/00* (2013.01); *F04B 2201/0603* (2013.01); *F04B 2201/0605* (2013.01); *F04B 2205/03* (2013.01); *F04B 2207/70* (2013.01)

(58) Field of Classification Search
CPC ..... F04B 49/10; F04B 49/20; F04B 51/00; F04B 2201/0209; F04B 2201/0603; F04B 2201/0605; F04B 2205/03; F04B 2205/503; F04B 2205/13
See application file for complete search history.

(56) References Cited

U.S. PATENT DOCUMENTS

| | | | | |
|---|---|---|---|---|
| 2005/0262838 | A1* | 12/2005 | Kageyama | F15B 21/085 60/453 |
| 2007/0041845 | A1* | 2/2007 | Freudenberger | F04B 13/00 417/63 |
| 2008/0190176 | A1* | 8/2008 | Muller | F04B 51/00 702/138 |
| 2012/0312399 | A1* | 12/2012 | Gerz | F04B 53/06 417/211.5 |
| 2016/0177937 | A1* | 6/2016 | Liu | F04B 49/065 417/44.1 |
| 2017/0002635 | A1* | 1/2017 | Williams | F04B 49/20 |
| 2020/0011309 | A1 | 1/2020 | Gerz et al. | |

FOREIGN PATENT DOCUMENTS

| | | | | |
|---|---|---|---|---|
| CN | 105492768 | A | 4/2016 | |
| DE | 19738844 | A1 * | 4/1999 | F04B 43/067 |
| EP | 3501226 | A1 | 6/2019 | |
| EP | 3591226 | A1 | 1/2020 | |
| WO | 2018033148 | A1 | 2/2018 | |

* cited by examiner

MONITORING METHOD FOR MONITORING THE OPERATION OF A DOSING PUMP AND DOSING PUMP SYSTEM

CROSS REFERENCE TO RELATED APPLICATIONS

This application claims the benefit of priority under 35 U.S.C. § 119 of European Application 21 181 652.5, filed Jun. 25, 2021, the entire contents of which are incorporated herein by reference.

TECHNICAL FIELD

The invention relates to a monitoring method for monitoring the operation of a dosing pump and to a corresponding dosing pump system including a dosing pump.

TECHNICAL BACKGROUND

Dosing pumps are positive displacement pumps. The present invention relates to a dosing pump having a displacement element and a drive for moving the displacement element. The displacement element alternately increases and decreases the volume of a pumping chamber for suction and delivering a liquid. The volume of the liquid delivered is defined by the change in size of the pumping chamber achieved by movement of the displacement body.

To achieve a higher accuracy in delivering rate it is known to have an electronic control of the drive of the metering pump and in particular to monitor the position of the displacement element and the pressure inside the pump or dosing chamber. For example, EP 3 501 226 A1 discloses monitoring the pressure and creating an indicator diagram plotting the pressure over the stroke lines. It is possible to detect certain faults or malfunctions like cavitation in this indicator diagram.

SUMMARY

It is an object of the invention to provide a monitoring method for monitoring an operation of a dosing pump and a corresponding dosing pump system which allows a detection of future faults or malfunctions in an early stage and allows a suer to react.

This object is achieved by a monitoring method having features as disclosed herein and by a dosing pump system having features as disclosed herein. Preferred embodiments are disclosed and described in the following with reference to the accompanying drawings.

The monitoring method according to the invention may be carried out by a control device of a dosing pump including suitable electronic components like for example a central processing unit (CPU) and storage means and preferably software for providing the monitoring method.

The monitoring method is used for monitoring the operation of a metering or dosing pump, the dosing pump having a dosing or pump chamber with at least one displacement element and an electric drive. The electric drive moves the displacement element, preferably in reciprocating manner so that the displacement element by its movement increases and decreases the volume of the dosing chamber. The change in volume of the dosing chamber defines the delivered liquid volume.

According to the method a position of the displacement element and a pressure inside the dosing chamber or a related indicator like a related force or torque are detected and recorded continuously as a curve in a pressure-stroke diagram or indicator diagram, respectively. The curve may be an accumulation of measuring points detected over time, preferably continuously or periodically in predefined intervals. A related force or torque may be a force acting on the drive of the displacement element, for example a drive motor. The force or torque acting on the drive are substantially (essentially) proportional to the pressure inside the dosing chamber. Therefore, for the invention it may be sufficient to consider and use a force or torque instead the actual pressure. In the following description the pressure inside the dosing chamber or a related force or torque may be regarded as being interchangeable. For detecting the position of the displacement element, the pump may comprise a position sensor or the electric drive may be a stepper motor such that the position can be determined by counting the rotational angle of the electric drive motor. For detecting the pressure there may be provided a pressure sensor detecting the pressure inside the dosing chamber. In an alternative solution the pressure may be calculated on the basis of the drive torque or force provided by the drive motor in knowledge of the mechanical connection between the electric drive and the displacement body. The drive torque may for example be measured by a respective torque or force sensor or may be derived from electric values of the electric drive.

According to the monitoring method at least one characteristic portion of said curve in said pressure-stroke diagram is analyzed and monitored. The characteristic portion of said curve may be a portion which is characteristic for a certain problem or malfunction, i.e. a portion of the curve which shifts or changes in the case that a certain problem or malfunction occurs. This means this portion of the curve may show a certain behavior of the dosing or metering pump, in particular resulting from a problem or malfunction. Thereby, changes in the characteristic portion of the diagram are regarded. In particular it is regarded whether the characteristic portion of said curve changes or shifts or moves in a certain direction over time or over several strokes, respectively. In case that a shift of the characteristic portion over time or over several strokes is recognized, according to the method in the next step, a measure or action is initiated to delay, to prevent and/or predict a malfunction in the future (at a future time). The first possible action would be to adjust a control of the electric drive in response to the detected shift of the at least one characteristic portion to compensate the shifts or to prevent or reduce a further shift in the future. By this it is possible to compensate the cause of the shift to prevent a malfunction in the future or to prolonge the time until a certain malfunction of the system will occur, in particular until the dosing must be stopped. A further, additional or alternative action which may be taken after determining a shift of the characteristic portion of the curve would be a prediction whether and/or when the shift will reach a predefined limit in the future, which for example would require to switch off the pump. For this prediction a trend of the shift of the characteristic portion is determined, i.e. the speed of the movement or shift of the characterizing portion. On the basis of this trend it is determined whether and/or when the shift or movement of the characteristic portion will reach a predefined limit in the future. For example, the time period until the shift or movement of the characteristic portion will reach a predefined limit in the future can be calculated or predicted. Thus, the speed of the shift is detected and an extrapolation for the future is made to determine whether and/or to calculate when the shift will reach a predefined limit. This may for example be the limit when the pump must be repaired or switched off, since it cannot ensure the desired dosing performance, e.g. accuracy or required back pressure anymore. With this method according to the invention a sudden unexpected stoppage of the dosing process can be prevented, instead a prediction and/or compensation of a malfunction is possible to ensure that there is enough time to take necessary steps for repair or maintenance of the dosing pump avoiding unplanned interruptions of production. The compensation of a malfunction by adjusting the control and the prediction as explained before can be used in combination or as alternatives.

According to a preferred option the calculated time period is output as a predicted time until failure to a communication device, a display device and/or a control device. In addition or alternatively, preferably a warning may be output to a communication device, a display device and/or a control device. The warning may be an information on an upcoming failure together or without the information about the expected time of a failure. By such output it is possible to inform an operator or for example a connected facility control system in an early stage to give enough time to plan a repair or maintenance of the dosing pump ensuring a minimized off-time of the dosing pump and avoiding metering inaccuracies.

For determining the trend of the shift of the curve or at least a characteristic portion of the curve, respectively, the average speed of the shift of the characteristic portion is taken. The average speed can be calculated as a moving average, for example considering a defined number of the last strokes of the displacement element. By considering the average trend or average speed, short trend fluctuations or peaks remain out of consideration, or the influence of such peaks is reduced. In the result short trend fluctuations or peaks are filtered out.

For calculating the time period until the shift of the characteristic portion will reach a predefined limit value in the future, preferably, an extrapolation on the basis of the trend is carried out. This means the movement or shift determined in the past is projected into the future on the basis of the rate of the determined shift.

Preferably the remaining interval between the last recorded value or an average of the last recorded values of the characteristic portion and said predefined limit is taken as a the basis for this calculation or extrapolation of the time period until the limit will be reached. The recorded value or recorded values may be points representing a characteristic point or a characteristic portion of the curve. In case that several points are considered, for example the average of the shift or trend of the points may be considered when calculating or predicting the time period until the predefined limit is reached. The predefined limit may consist of several limit values, for example different limit values for different points representing the characteristic portion of the curve.

Said characteristic portion of the curve, preferably, is defined by at least one characteristic point, preferably by at least one set of characteristic points of the curve. This may for example be the portion of the curve representing the suction or pressure stroke or points of the curve representing the opening or closing of the valves on the entrance (intake) and outlet side of the dosing chamber, or representing the opening time of the valve, i.e. the suction or discharge phase.

Furthermore, the characteristic points or portions of the curve may be transition sections or regions in the curve between different phases of the movement of the displacement element, for example the transition region between suction and discharge or pressure stroke and/or portions of the curve representing a pressure buildup.

Further preferred, the characteristic portion or characteristic portions of the curve may be at least one section of the curve, a turning point or a turning portion of the curve, an inflexion point or inflexion portion of the curve and/or a saddle point or saddle portion of the curve. As mentioned before those characteristic portions may represent a certain phase of the movement of the displacement element or of the operation of the dosing pump and can be identified in the curve, in particular by a control system or computer system carrying out the monitoring method as described.

The considered or monitored at least one characteristic portion of the curve, for example, is an indicator for cavitation, air inside a pumping cavity, overpressure, leakage, valve leakage (for example of a suction valve, pressure valve and/or pressure loading valve), clogging of a flow path, for example clogging of the suction line, malfunction of a pulsation damper and/or line burst. For example, air inside the dosing chamber or pumping cavity respectively, would result in a slower or flatter pressure buildup, so that the portion of the curve representing the pressure buildup is flatter. With increasing air, the curve will move to a flatter course. An increasing pressure over time in the characteristic portion of the curve representing the discharge phase may be an indicator for a clogging of the pressure line or a malfunction of the outlet valve. Increasing pressure spikes or peaks during the pressure stroke or in the portion of the curve representing the discharge phase of the stroke may indicate a malfunction of a pulsation damper or damping element. Cavitation, for example may be recognized if the characteristic portion of the curve representing the suction stroke reaches zero pressure, atmosphere pressure or a pressure balance later during the suction stroke. For example, in the indicator diagram the point crossing the coordinate axis representing zero or atmosphere pressure moves over time or several strokes.

As already mentioned above, the at least one characteristic portion of the curve considered may be in a section of the curve representing a suction stroke of the displacement element, in a section representing the discharge phase, in a section of the curve representing a pressure stroke of the displacement element, in a section or the curve representing an expansion phase, in a section of the curve representing a phase of pressure buildup and/or at least one transition section between those sections of the curve. In a diagram of pressure and stroke, preferably, the stroke is shown on the x-coordinate or axis of abscissae, whereas the pressure is plotted on the y-coordinate or axis of ordinates. As described above, instead of the pressure a force or torque related to this pressure, i.e. being proportional to this pressure, may be plotted on the y-coordinate. In such a diagram there is a lower section of the curve representing the suction stroke, an increasing section on the left of the diagram representing the pressure buildup, an upper section of the curve, substantially horizontal, representing the discharge phase and a decreasing section on the right side representing the transition between pressure stroke and suction stroke, i.e. an expansion phase.

The calculation of the time period, according to a preferred option is periodically updated, for example after every stroke or after a certain number of strokes. As described above this may be done on the basis of a moving average.

According to a further possible embodiment the control of the electric drive may be adjusted by changing the stroke pattern to compensate a detected malfunction causing the detected shift of the at least one characteristic portion, preferably, to at least partly reduce the shift or to decelerate a future shift of this characteristic portion. For example, in case that a malfunction of a pulsation damper is detected this may be compensated by reducing the speed of the stroke at the beginning of the pressure stroke and increasing the speed during the following portion of the pressure stroke. This can be done by controlling the speed of the electric drive, in particular a drive motor, like for example a stepper motor. To compensate cavitation, the speed of the suction stroke may be reduced at the beginning of a suction stroke, for example.

The dosing pump system according to the invention preferably is configured to carry out the monitoring method as described above. In view of this, the different options of the method described above may be regarded as preferred embodiments of the dosing pump system, too, and vice versa. The dosing pump system according to the invention comprises a dosing pump having a dosing chamber or pumping cavity respectively, and at least one moveable displacement element. The displacement element by its movement increases and decreases the volume of the dosing chamber. Preferably, the moveable displacement element, for example a membrane or plunger, is moveable in reciprocating manner. A drive, preferably an electric drive is connected to said displacement element for moving the displacement element, preferably as described before. The drive may be an electric drive motor, for example a stepper motor, or a magnetic drive. In case of the use of a rotating drive motor there may be arranged a gearing mechanism to transfer the rotational movement of the drive motor into a reciprocating movement of the displacement element. For example, the gear mechanism may comprise an eccentric or crank element.

The dosing pump system according to the invention furthermore comprises a control device, in particular an electronic control device. The electronic control device may comprise usual electronic components, for example a CPU, storage means and in particular software for providing a desired control functionality. The control device is configured such that it continuously records the position of the displacement element and a pressure inside the dosing chamber or a related indicator as a curve in a pressure-stroke diagram or indicator diagram, respectively. For detecting the position of the displacement element there may be provided a position sensor or a sensor detecting the angular position of a drive. Alternatively, the position may be detected directly via the drive, in particular if the drive is as stepper motor. Furthermore, it would be possible to calculate the position on the basis of a time when knowing the velocity and starting from a reference of a stroke position. The reference may for example be detected by a suitable sensor like a hall sensor. The position may be received by counting the steps of the drive motor starting from an initial position detected in a suitable way, for example by a position sensor for detecting the initial position.

Furthermore, the control device is configured such that it monitors at least one characteristic portion of said curve inside the pressure-stroke diagram. The at least one characteristic portion is predefined in the control device, in particular a monitoring module or software of the control device. The control device may be configured to detect the at least one characteristic portion in the diagram. By monitoring the at least one characteristic portion the control device detects a possible shift of the characteristic portion over several strokes of said displacement element or over time, respectively. The shift is a movement of the characteristic portion in a certain direction. This shift or movement of the characteristic portion may be an indicator for a change inside the dosing pump system or the dosing pump, for example due to wear. For example, sealing elements or valves may wear out, cavities or channels containing the liquid may clog or a leakage may occur. Furthermore, damping elements like a pulsation damper may get damaged. A further possible problem may be gas bubbles inside the liquid to be pumped or cavitation occurring during the suction stroke. These are examples for occurring problems which may result in a shift or movement of characteristic portions of the curve which may be detected or monitored by the control device, however, this is not a complete list of detectable problems. When detecting a shift of the characteristic portion, i.e. a movement or shift by a predefined degree the control device according to the invention initiates further actions to compensate the underlying problem and/or to signalize (signal or indicate) an upcoming problem or malfunction to an operator or a connected control device, in an early stage. The control device according to a first option may be configured to adjust a control of the electric drive on the basis of the detected shift, i.e. in response to the detected shift of the at least one characteristic portion. By adjusting the control in a predefined manner, the control device may compensate or at least partly compensate the problem causing the shift of a certain characteristic portion of the curve. As mentioned above, for example the speed at the beginning of the pressure-stroke may be decreased in case that a shift of a characteristic portion at the beginning of the pressure-stroke signalizes pressure spikes or peaks which may occur from a malfunction of a pulsation damper. By reducing the speed at the beginning of the stroke, these pressure peaks may be reduced. For further compensation, the speed in the following pressure-stroke may be increased, in particular slowly increased. On the other side it may be possible to decrease the speed at the beginning of the suction stroke in case that the movement or shift of the characteristic portion of the curve representing the suction stroke, signalizes occurring cavitation. In case that a certain characteristic portion of the curve signalizes for example a leakage, the time for a suction and/or pressure-stroke may be shortened or extended or the number of strokes per time may be increased to compensate the loss of liquid to be delivered.

There is an additional or alternative option to react on a detected shift of the characteristic portion of the curve. For this the control device preferably is configured such that it determines a trend of the shift, i.e. the speed of the shift and on the basis of this trend determines whether and/or when the shift of the characteristic portion will reach a predefined limit in future. In particular the control device may be configured to calculate the time period until the shift will reach this limit. Thus, the control device preferably is configured to make an extrapolation into the future on the basis of the trend detected in the past. The control device preferably is configured to determine the speed of the shift in a certain period of time or during a certain number of strokes. Then, the control device may take the detected speed and on the basis of this speed calculate how long it will take until the shift will reach a predefined limit in the future. This calculated time period may be output in suitable manner to an operator to a further control device.

Preferably, the control device is connected to a display device and/or comprises a communication device such that the calculated time period is output as predicted time until failure to or by the display device or to a connected control device. The display may be part of the dosing pump system, for example a display on the pump controller used for further control functionality. The output of the predicted time until failure, i.e. until the shift will reach the predefined limit, offers enough time to arrange a repair or maintenance of the dosing pump such that an interruption of production can be avoided or minimized.

According to a further possible embodiment the control device and the dosing pump are integrated into a dosing pump unit, i.e. are parts of a dosing pump unit. Alternatively, the control device may be arranged distanced from the dosing pump and connected to the dosing pump via a data connection, preferably a network connection. For example, the control device or at least a part of the control device may be connected to the dosing pump via a network connection like the internet. Thus, several control options, in particular the monitoring of the pressure-stroke diagram may be carried out by a cloud computing device, i.e. a software application executed on a computer system connected to the dosing pump via a network connection. The dosing pump may additionally have an internal controller, in particular operating the communication with an external control device. A monitoring module carrying out the monitoring of the pressure-stroke diagram may be integrated into an internal controller or into an external controller.

According to a further possible embodiment the dosing pump has at least one force sensor and/or at least one pressure sensor connected to the control device such that the control device receives force and/or pressure values from those sensors representing the pressure inside the dosing chamber. Alternatively, the control device may be connected to the electric drive motor to receive motor data representing or being proportional to the pressure inside the dosing chamber. In particular, the force acting on the drive motor or the torque acting on the drive motor may be derived from the electric parameters of the drive motor. A pressure sensor may be arranged inside or at the dosing chamber to detect the liquid pressure inside the chamber. This allows for a to direct detection of the pressure. However, also an indirect detection or calculation is possible. It may be possible to use a sensor for detecting the force acting on the displacement element and to calculate the pressure on the basis of this force in knowledge of the size of the displacement element. Furthermore, it may be possible to detect the torque acting on the drive by at least one suitable sensor and/or on the basis of electrical parameters of the drive motor. With knowledge of the gear mechanism connecting the displacement element and the drive motor it is possible to calculate the pressure inside the dosing chamber.

According to a further preferred embodiment, corresponding to the first option of the method mentioned above, the control device is configured such that the stroke pattern of the displacement element can be changed to compensate for a malfunction causing the detected shift of the at least one characteristic portion, and preferably to at least partly reduce the detected shift. In particular it may be possible to slow down the shift in the future to extend the time period until the predefined limit will be reached. A change in the stroke pattern may for example be a reduced speed at the beginning of the pressure stroke or suction stroke, for a reduction of occurring pressure peaks or to avoid cavitation. A further change in the stroke pattern may be an increased speed to increase the feed rate to compensate leakage. The control device may be configured to make any suitable change in the stroke pattern to compensate malfunctions and preferably prolong the operation until predefined limits will be reached, which would require maintenance or a stop of operation.

According to a further preferred embodiment the control device of the dosing pump system is configured such that it carries out a monitoring method as described above. The control device in particular contains a monitoring module, preferably as a software application carrying out the monitoring method as described. The control device may have a controller integrated into the pump unit. Alternatively or additionally an external computing device, in particular a cloud computing device may act as a part of the control device and carry out control functions and preferably the monitoring method as described above.

In the following the invention will be described which reference to the accompanying drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
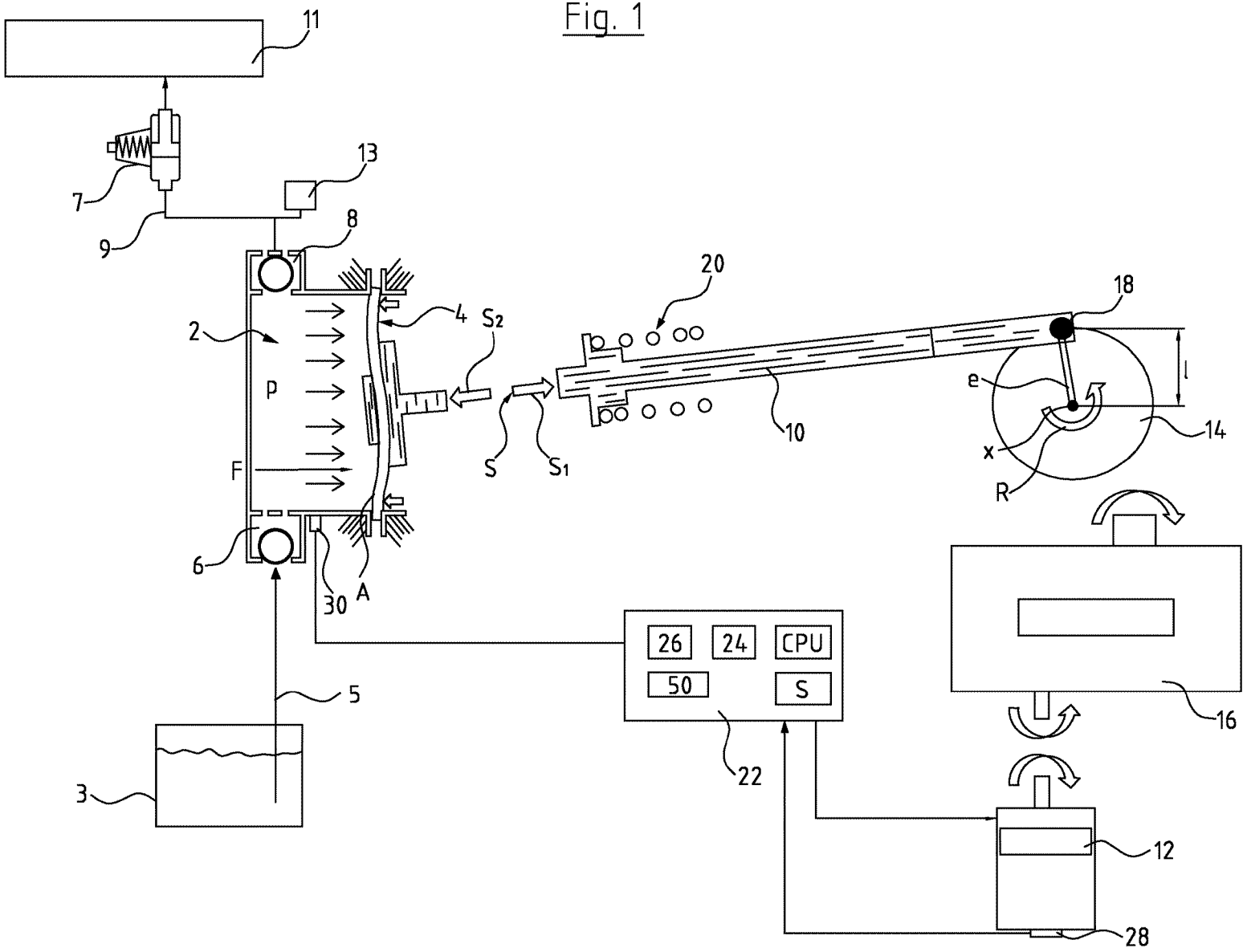
FIG. 1 is a schematic view of a dosing pump according to the invention.

Referring to the drawings, FIG. 1 as an example of a dosing or metering pump shows a membrane pump. It has to be understood that the invention may be carried out in similar manner with other type of dosing pumps, for example metering or dosing pump using a piston instead of a membrane as a displacement element. The pump as shown in FIG. 1 has a pump or dosing chamber 2, a side wall of which is formed by a membrane 4. This membrane 4 is the displacement element. By displacement of the membrane 4 the volume inside the dosing chamber 2 can be increased for filling the dosing chamber 2 and decreased for discharging the liquid from the dosing chamber 2. At the lower side of the dosing chamber 2 there is arranged a suction valve 6 whereas on the opposite side there is arranged a pressure valve 8. Both valves are designed as check valves. In this case where the ball shaped valve elements are closing the valve by gravity. However, additionally a biasing element as a spring can be provided. During operation liquid is sucked from a liquid container 3 via a suction line 5 through the suction valve 6 into the dosing chamber 2 and discharged out of the dosing chamber 2 through the pressure valve 8. From the pressure valve 8 the liquid is discharged via a pressure line 9 and a pressure loading valve 7 for example into a pipe 11 of a facility. The pressure loading valve 7 in the pressure line 9 defines the pressure in the pressure line 9, i.e. maintains the pressure on the outlet side of the pressure valve 8 at a predefined pressure. This pressure is set by the pressure loading valve 7. Connected to the supply line 9 is a pulsation damper 13 for equalizing a pressure pulsation occurring in the outlet or pressure line 9.

The membrane 4 is moved in a reciprocating manner via the connection rod 10. For driving the connection rod 10 in the reciprocating manner there is provided an electric drive in the form of an electric drive motor 12, for example a stepper motor. The rotating drive motor 12 moves the connection rod 10 via an eccentric drive 14 transferring the rotational movement into a linear reciprocating movement. The eccentric drive 14 is coupled to the electric drive motor 12 via a gear drive 16. The connection rod 10 is connected to the eccentric drive 14 at a connection point 18 which is distanced (spaced a distance) from the rotational axis x of the eccentric drive 14 by the eccentricity e. This causes the linear movement of the connection rod 10 into direction S if the eccentric drive 14 is rotated in the rotational direction R. In this example, furthermore, a spring 20 is arranged in the drive. The spring 20 is a compression spring connected to the connection rod 10 such that the spring 20 is compressed when the connection rod 10 is moved backwards into direction S1 moving the membrane 4 in the retracted position. The spring 20 can accumulate energy during the suction stroke. This energy is released during the pressure stroke when the connection rod 10 together with the membrane 4 is moved in the forward, i.e. advanced position in the direction S2. By this the spring 20 smoothes the torque to be applied by the electric drive motor 12 during the entire stroke. It has to be understood that it is also possible to arrange a spring that is compressed during the pressure stroke and acts as a return spring. Furthermore, the invention may also be realized without a spring 20.

The dosing pump has a control device 22 controlling the electric drive motor 12. The control device 22 comprises a monitoring module 24 for monitoring the operation of the dosing pump. The control device 22 may comprise usual electronic components like in particular a CPU, a storage device and software applications for control of the dosing pump. The monitoring module 24 may preferably be realized as a software module. In this example the monitoring module 24 is integrated into a control device 22. However, it would be possible to transfer information to an external computing or monitoring device, in particular a cloud device acting as a monitoring module 24. For this the control device 22 may comprise a communication interface 26.

The monitoring module 24 is configured to continuously record a pressure P inside the dosing chamber 2 and the position of the displacement element. The pressure inside the dosing chamber 2 and the position of the displacement element, i.e. the membrane 4 are recorded as a curve in the pressure-stroke diagram. For detecting the position of the membrane 4 along the direction S in this example an encoder 28 detecting the angular position of the rotor of the drive motor 12 is used. Furthermore, it is possible to detect certain positions of the drive or the displacement element, for example by a single sensor and to calculate the further positions on the basis of the known velocity of the displacement element and the time past. Furthermore, instead of a special encoder a stepper motor may be used. With knowledge of the transmission ratio of the gear drive 16 and the geometrical design of the eccentric drive 14 based on the angular position, the position in direction S can be calculated. The pressure P inside the dosing chamber 2 may either be detected by a pressure sensor 30 or may be indirectly detected by detecting the torque of the drive motor 12 or a force acting in the drive (pressure related indicators) and calculating the pressure P on the basis of the force F acting onto membrane 4. In this example a pressure sensor 30 is arranged at the dosing chamber 2 and connected to the control device 22. In case that a force or torque is detected, it would be possible to continuously record this torque or pressure over the position of the displacement element instead of recording the pressure. In view of this pressure and the proportional force or torque can be regarded as being equivalent (the pressure related indicators).

Figure 2:
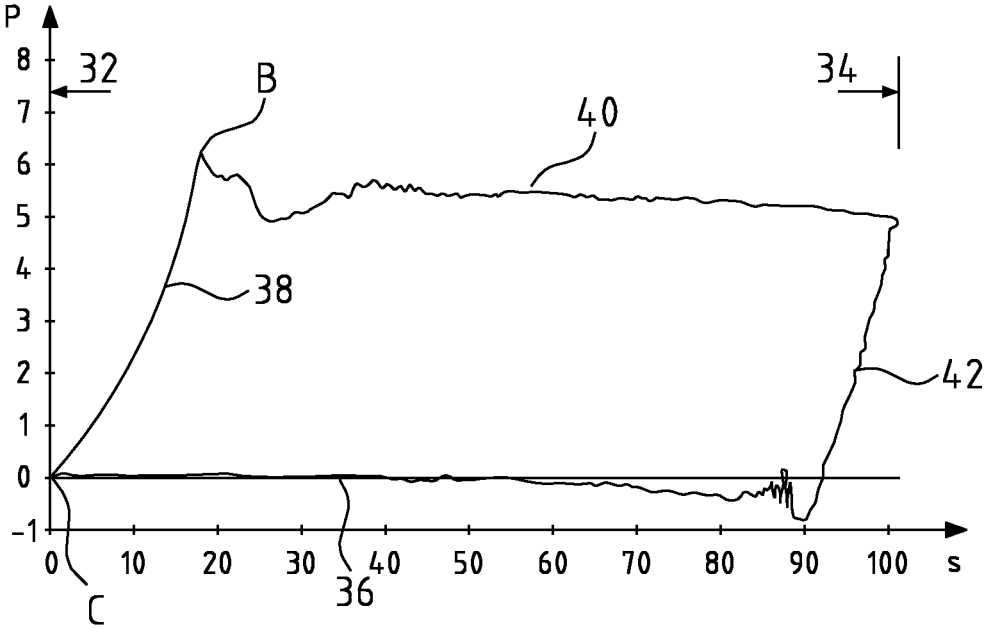
FIG. 2 is a pressure-stroke diagram.

FIG. 2 shows the pressure-stroke diagram as detected by the monitoring module 24 in general. The abscissa shows the stroke lengths S in percent, i.e. the linear movement of the membrane 4 between its position representing the minimum volume of the dosing chamber 2 and the position defining the maximum volume of the dosing chamber 2. The ordinate shows the pressure P as detected by the pressure sensor 30. A stroke of zero percent corresponds to the lower dead center 32 and the stroke length of hundred percent corresponds to the upper dead center 34. The curve in the diagram comprises four main portions, forming characteristic portions, representing the four essential phases of the membrane movement. The lower portion of the curve represents the suction phase 36, the portion with rapidly increasing pressure on the left side represents the compression phase 38, the upper portion represents the discharge phase 40 and the right portion with rapidly decreasing pressure represents an expansion phase 42. The expansion phase 42 together with the suction phase 36 corresponds to a movement of the membrane 4 in the direction S1, whereas the compression phase 38 and the discharge phase 40 form the pressure stroke in direction S2.

The monitoring module 24 of the control device 22 continuously records or monitors the pressure-stroke diagram so that changes in the pressure-stroke diagram over time or over several strokes can be detected by the monitoring device. Different problems or malfunctions which may occur in the dosing pump have different effects on the course of the curve in the pressure-stroke diagram. Those effects are discussed in more detail with reference to FIGS. 3 to 8.

Figure 3:
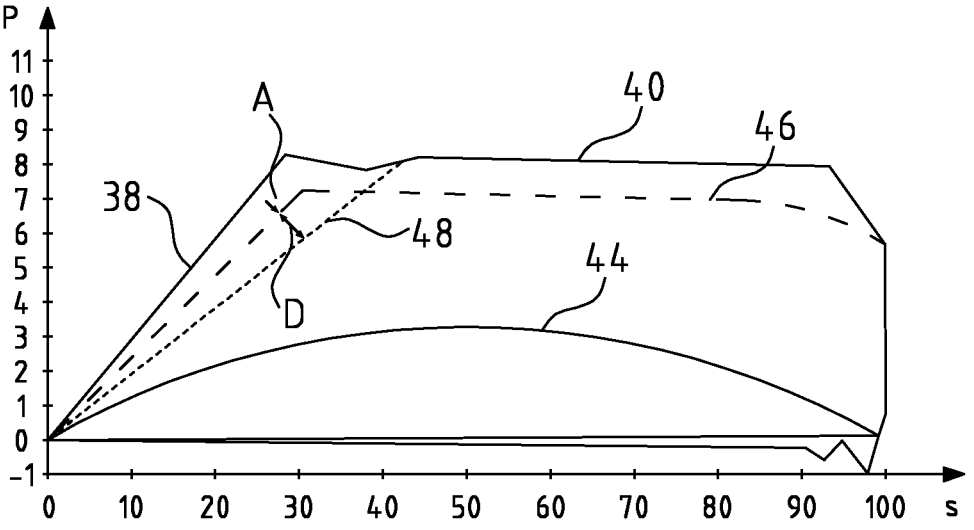
FIG. 3 is a pressure-stroke diagram in case of a leakage.

In FIG. 3 there is shown an abnormal curve 44 which will occur in case that the suction valve 6 or dosing chamber 2 has a leakage. In this case there is less or no pressure buildup, since the liquid flows back into a suction line or out of dosing chamber 2. In case of a suddenly occurring leakage, the curve may directly change to a course of the curve 44 as shown in FIG. 3. However, in most cases the leakage will increase slowly so that the curve will shift over time from the course 38 and 40 towards the course 44. This is indicated by the curve 46 in broken line which shows an intermediate condition. The shift A of the characteristic portion 38 is detected by the monitoring module 24 over time so that a trend, i.e. the speed of the shift A can be calculated. The dotted line represents a limit curve 48. This is a predefined acceptable limit 48 for the shift A. When this limit is reached the dosing pump has to be repaired and the production has to be stopped, for example. On the basis of the trend of the shift A it is possible to make a prediction whether this time limit will be reached in the future and when this limit will be reached. In knowledge of the distance D remaining between the present position 46 of the characteristic portion 38 and the limit curve 48 the time when the limit 48 will be reached can be calculated. This can be output by the control device 22 for example on a display 50 or output to an external control device connected via the communication interface 26.

As an alternative or in addition to this prediction the control device 22 may initiate a compensation at least partly eliminating the shift A of the curve or reduce the speed of the shift A to prolonge the time until the limit 48 will be reached. This can be done by changing the control of the electric drive motor 12 such that a different stroke pattern is realized. For example, the speed may be increased to compensate a loss of liquid to be delivered due to the leakage.

Figure 4:
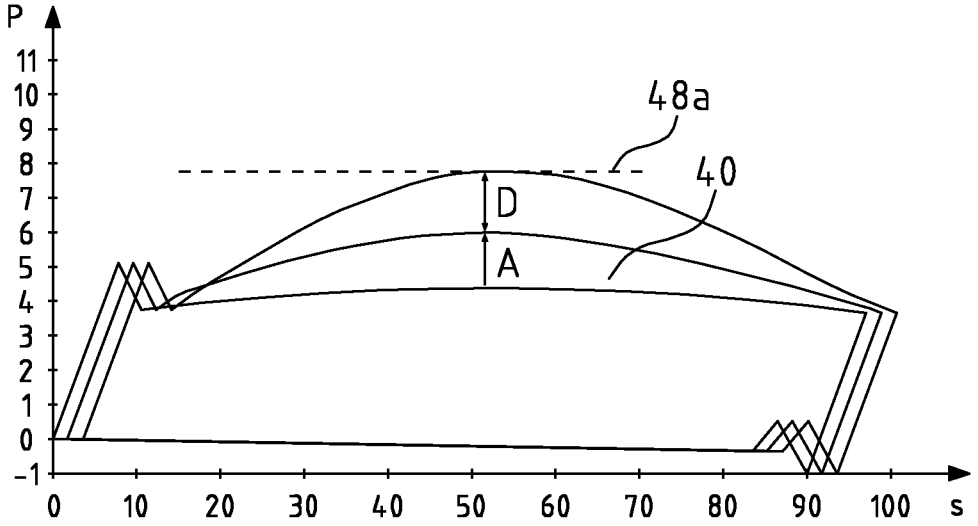
FIG. 4 is a pressure-stroke diagram in case of different diameters or resistance of a pressure line.

FIG. 4 shows a further possible malfunction which may be detected. FIG. 4 shows the course of the characteristic portion 40 of the curve in case that the pressure line 9 connected to the pressure valve 8 has a reduced crosssection, for example due to clogging. In this case the shift A is in a direction to higher pressure, i.e. the pressure in the discharge phase 40 will increase over time. By detecting the trend, i.e. the speed of the shift A over several strokes it is possible to make an extrapolation to predict the time for the remaining shift A until the limit value 48*a* will be reached.

Figure 5:
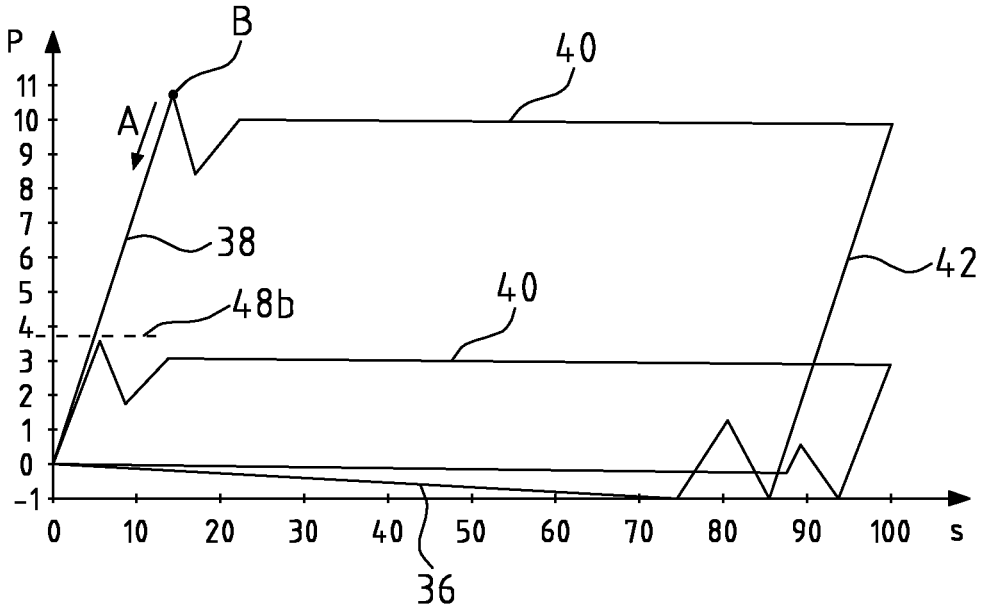
FIG. 5 is a pressure-stroke diagram in case of a malfunction of the pressure loading valve.

FIG. 5 shows the course of the curve in the case that the pressure loading valve 7 is not closing completely, for example due to dirt or wear. In this case the characteristic point B being the transition point between the compression phase 38 and discharge phase 40 will move in the direction of shift A towards lower pressure and the maximum pressure P will be reached earlier in the stroke. The point B thus, moves substantially along the curve representing the compression phase 38 towards lower pressure. This occurs since the maximum pressure P cannot be reached anymore. However, in a difference compared to the curve shown in FIG. 3 there is still a pressure buildup with substantially unchanged inclination, since the suction valve 6 still securely closes. Also, in this case the trend of the shift A can be detected to make a prediction how long it will take in the future until a limit value 48*b* will be reached.

Figure 6:
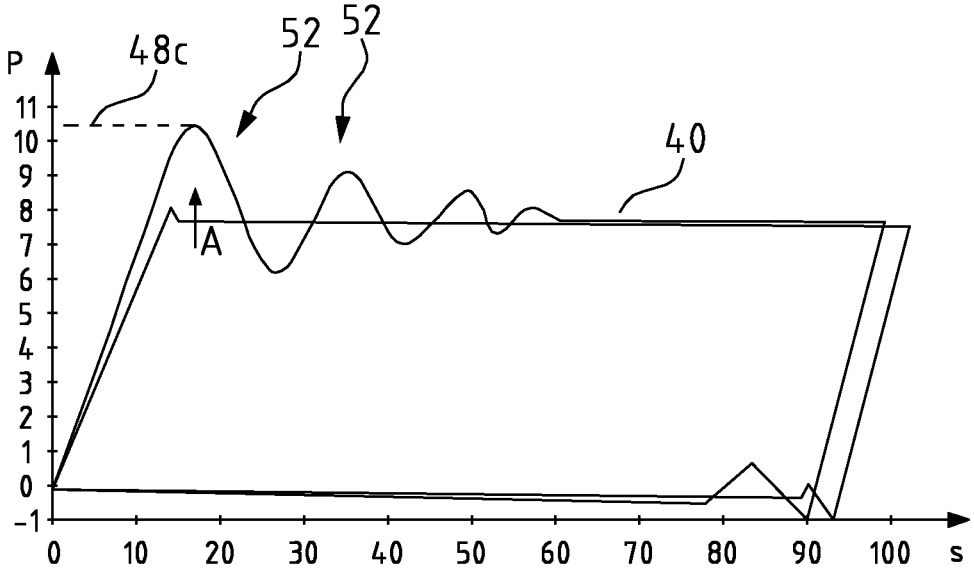
FIG. 6 is a pressure-stroke diagram in case of pressure peaks.

FIG. 6 shows the curve with pressure peaks or spikes 52 in the discharge phase 40 in consideration to the stroke frequency. Those pressure peaks or spikes 52 may occur in case that the pulsation damper or damping element has a failure or is not installed in a correct way. In case of a slowly occurring failure these spikes or peaks 52 will increase over time. Thus, also in this case a shift A can be detected, and a trend of this shift A can be calculated to make an extrapolation or prediction until a certain limit value 48*c* will be reached. Furthermore, also in this case the control device 22 preferably makes a compensation control action to reduce or avoid these pressure peaks 52. This can for example be done by reducing the speed of the drive motor 12 at the beginning of the discharge phase 40.

Figure 7:
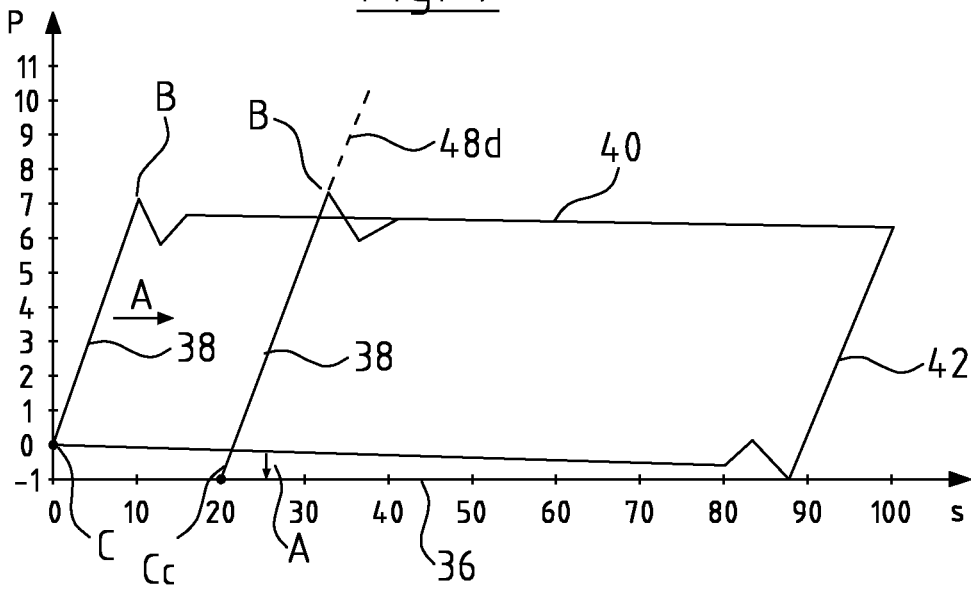
FIG. 7 is a pressure-stroke diagram in case of occurring cavitation.

FIG. 7 shows the curve in case of occurring cavitation. In this case there will be a shift A of the characteristic portion of the curve representing the suction phase 36. With increasing cavitation in the suction stroke 36, pressure equalization will be reached later. Thus, there is a shift A of the characteristic portion 36 of the curve towards lower pressure. At the same time the characteristic portion 38 has a shift A to the right side in the diagram according to FIG. 4, i.e. the pressure buildup will occur later during the pressure stroke, since first the pressure equalization must be reached. Also, in this case a slowly occurring or increasing cavitation over several strokes can be recorded and a trend of the shift A can be calculated and used for an extrapolation to predict when a limit 48*d* will be reached.

Figure 8:
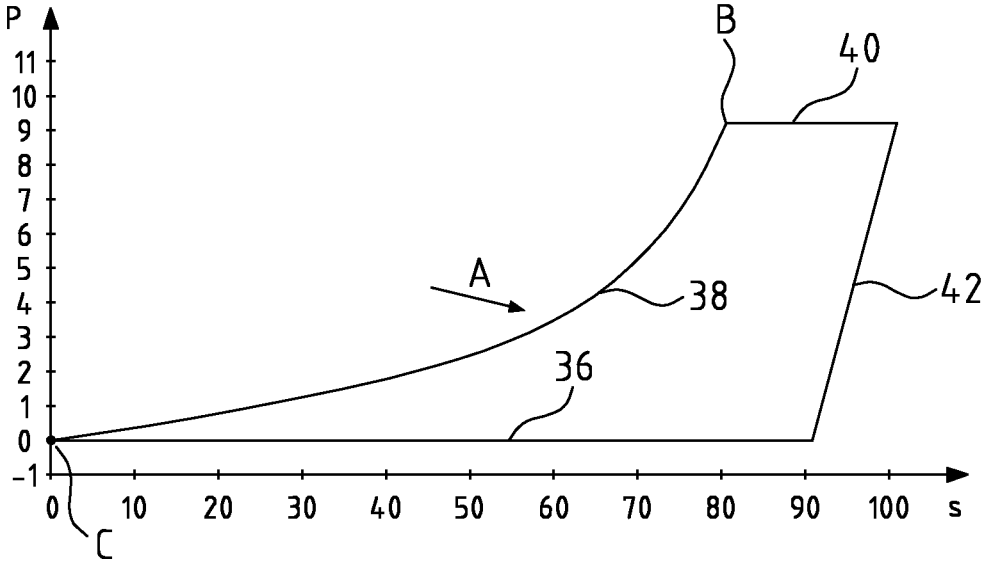
FIG. 8 is a pressure-stroke diagram for the case of gas bubbles in the dosing chamber.

FIG. 8 shows a curve in case that air bubbles occur inside the liquid in the dosing chamber 2 or the dosing chamber 2 is filled with air only. Due to the compression of the air in this case the pressure buildup requires a greater stroke length, i.e. takes longer with the effect of a reduced discharge. Also, in this case there is a shift A of the characteristic portion 38 representing the compression phase towards a greater stroke length, i.e. to the right side in FIG. 8. However, compared to occurring cavitation there is a further difference. The characteristic portion 38 is increasingly curved and there is no shift of the characteristic portion 36 of the curve and in particular not of the characteristic point C representing the transition point between suction phase and compression phase. If there is an increasing amount of air inside the system over several strokes, also in this case a trend of the shift A can be taken to make a prediction when a predefined limit will be reached.

It has to be understood that the problems explained with reference to FIGS. 3 to 8 are examples, only. There are further occurring problems or malfunctions which can be detected by monitoring the curve in the pressure-stroke diagram. In all cases the shift A of a characteristic portion or point in the curve or several characteristic portions and/or points are detected by the monitoring module 24. Furthermore, it is possible to calculate a trend, i.e. a speed of the shift over time or over several strokes and to make a prediction for the future when a predefined limit will be reached in the future with the detected trend or speed of the shift. Thereby the remaining distance of the detected position of the characteristic point(s) or portion(s) and the limit is regarded. For the current point or position an average over a certain number of strokes may be regarded.

Furthermore, the control device 22 may change the drive pattern by changing the control of the drive motor 12 to compensate certain problems to eliminate the shift A or to prolonge the time until a limit will be reached.

While specific embodiments of the invention have been shown and described in detail to illustrate the application of the principles of the invention, it will be understood that the invention may be embodied otherwise without departing from such principles.

LIST OF REFERENCE CHARACTERS

2 dosing chamber, pumping cavity
3 liquid container
4 membrane, displacement element
5 suction line
6 suction valve
7 pressure loading valve
8 pressure valve
9 pressure line
10 connection rod
11 pipe
12 electric drive motor
13 pulsation damper
14 eccentric drive
16 gear drive
18 connection point
20 spring
22 control device
24 monitoring module
26 communication interface
28 encoder
30 pressure sensor
32 lower dead center
34 upper dead center
36 suction phase
38 compression phase
40 discharge phase
42 expansion phase
44, 46 curves
48, 48*a*, 48*b*, 48*c*, 48*d* limit
50 display
52 peaks R rotational direction
S, S1, S2 linear direction
e eccentricity
x rotational axis
A shift
P pressure
D distance
B, C characteristic points

What is claimed is:

1. A monitoring method for monitoring operation of a dosing pump comprising a dosing chamber with at least one displacement element and an electric drive, a controller connected to the electric drive, wherein a pressure indicating sensor and a position sensor are connected to the controller, the method comprising the steps of:

detecting a position of the displacement element with the position sensor, and a pressure inside the dosing chamber or a pressure related indicator with the pressure indicating sensor, and recording the position, and the pressure or the pressure related indicator as a curve in a pressure-stroke diagram;

monitoring at least one characteristic portion of said curve in said pressure-stroke diagram with the controller and detecting a shift of the at least one characteristic portion by comparing said characteristic portion of said curve of the pressure-stroke diagram over several strokes of the displacement element with the controller; and using the controller for determining a trend of the detected shift of the of the at least one characteristic portion over several strokes of the displacement element and determining based on the determined trend whether the detected shift of the least one characteristic portion will reach a predefined limit and when the detected shift of the at least one characteristic portion will reach the predefined limit in the future and based on the determination of when the detected shift of the least one characteristic portion will reach the predefined limit calculating a predicted time period until failure; and using the controller for at least one of:

outputting, to a communication device and/or display device, the calculated predicted time period until failure and/or outputting, to the communication device and/or display device a warning based on the predicted time period until failure;

adjusting a control of the electric drive prior to reaching the predefined limit at the calculated predicted time period; and switching off the dosing pump prior to reaching the predefined limit at the calculated predicted time period.

2. The monitoring method according to claim 1, the calculated predicted time period until failure and/or a warning based on the predicted time period until failure is output to the communication device, the display device and/or a control device.

3. The monitoring method according to claim 1, wherein the trend is determined based on an average speed of the shift of the at least one characteristic portion.

4. The monitoring method according to claim 1, wherein the predicted time period, based on when the shift of the at least one characteristic portion will reach the predefined limit, is calculated by an extrapolation based on the trend.

5. The monitoring method according to claim 1, wherein the predicted time period, based on when the shift of the at least one characteristic portion will reach the predefined limit, is calculated based on a remaining interval between a last recorded value of the at least one characteristic portion or an average of last recorded values of the at least one characteristic portion and said predefined limit.

6. The monitoring method according to claim 1, wherein said at least one characteristic portion is defined by at least one characteristic point of the curve.

7. The monitoring method according to claim 1, wherein said at least one characteristic portion is one or more of: a section of the curve; a turning point or turning portion of the curve; an inflexion point or inflexion portion of the curve; and a saddle point or saddle portion of the curve.

8. The monitoring method according to claim 1, wherein the at least one characteristic portion is one or more of: an indicator for cavitation; an indicator of air inside the dosing chamber; an indicator of overpressure; an indicator of leakage; an indicator of valve leakage; an indicator of clogging of a flow path; an indicator of malfunction of a pulsation damper; and an indicator of a line burst.

9. The monitoring method according to claim 1, wherein the at least one characteristic portion of the curve is one or more of: in a section of the curve representing a suction stroke of the displacement element; in a section of the curve representing a pressure stroke of the displacement element; in a section of the curve representing an expansion phase; in a section of the curve representing a phase of pressure buildup; and in at least one transition section between said sections of the curve.

10. The monitoring method according to claim 1, wherein the calculation of the predicted time period, based on when the shift of the at least one characteristic portion will reach a predefined limit, is continuously or periodically updated.

11. The monitoring method according to claim 1, wherein the control of the electric drive is adjusted by changing a stroke pattern to compensate for a malfunction causing the detected shift of the at least one characteristic portion, to reduce the detected shift at least partly or to decelerate a future shift.

12. The monitoring method according to claim 1, wherein the pressure indicating sensor is operatively connected to the controller and is configured to detect the pressure inside the dosing chamber or the pressure related indicator;

the the pressure indicating sensor comprising:

a force sensor connected to the controller such that the controller receives one or more of force values representing pressure inside the dosing chamber from said force sensor; or a pressure sensor connected to the controller such that the controller receives one or more of pressure values representing pressure inside the dosing chamber from said pressure sensor; or an electric drive signal connection from the electric drive to the controller to provide data representing pressure inside the dosing chamber, wherein the controller:

generates the output of the calculated predicted time period as the predicted time period until failure; and generates the output of the warning; and controls the electric drive prior to reaching the predefined limit at the calculated time period; and switches off the dosing pump prior to reaching the predefined limit at the calculated predicted time period.

13. A dosing pump system comprising:

a dosing pump, the dosing pump comprising:

a dosing chamber;

at least one movable displacement element associated with the dosing chamber; and an electric drive connected to said displacement element for moving the displacement element; and a controller connected to a pressure indicating sensor and a position sensor, the controller, the pressure indicating sensor, and the position sensor are configured to:

continuously record a position of the displacement element and at least one of a pressure inside the dosing chamber and a pressure related indicator as a curve in a pressure-stroke diagram with the controller;

monitor at least one characteristic portion of said curve in said pressure-stroke diagram with the controller;

detect a shift of the at least one characteristic portion by comparing said characteristic portion of said curve of the pressure-stroke diagram over several strokes of the displacement element using the controller; and determine a trend of the detected shift of the at least one characteristic portion and based on the determined trend determine whether the detected shift of the least one characteristic portion will reach a predefined limit and when the detected shift of the at least one characteristic portion will reach the predefined limit in the future and based on the determination of when the detected shift of the least one characteristic portion will reach the predefined limit calculating a predicted time period until failure with the controller; and using the controller for at least one of:

outputting, to a communication device and/or display device, the predicted time period until failure and/or outputting, to the communication device and/or display device, a warning based on the predicted time period until failure;

adjusting a control of the electric drive prior to reaching the predefined limit at the calculated time predicted period; and switching off the dosing pump prior to reaching the predefined limit at the calculated predicted time period.

14. The dosing pump system according to claim 13, further comprising at least one of the display device being connected to the controller and the communication device forming a part of the controller or being connected to the controller, wherein the controller is configured to:

output the calculated predicted time period via the at least one of the display device and the communication device.

15. The dosing pump system according to claim 13, wherein the controller and the dosing pump are integrated into a dosing pump unit or the controller is arranged at a distance from the dosing pump and connected to the dosing pump via a data connection.

16. The dosing pump system according to claim 13, wherein:

the dosing pump comprises the pressure indicating sensor; and the pressure indicating sensor is at least one of a force sensor and a pressure sensor connected to the controller such that the controller receives one or more of force values and pressure values representing pressure inside the dosing chamber from said at least one of a force sensor and a pressure sensor; or the controller is connected to the electric drive to receive data representing pressure inside the dosing chamber from said electric drive.

17. The dosing pump system according to claim 13, wherein the controller is configured such that a stroke pattern of the displacement element is changed to compensate a malfunction causing the detected shift of the at least one characteristic portion and to reduce the shift at least partly.

18. A dosing pump system comprising:

a dosing pump, the dosing pump comprising:

a dosing chamber;

at least one movable displacement element associated with the dosing chamber; and an electric drive connected to said displacement element for moving the displacement element;

a control device operatively connected to the electric drive; and detecting means to detect a pressure inside the dosing chamber or a pressure related indicator, the detecting means being operatively connected to the control device and comprising:

a force sensor connected to the control device such that the control device receives one or more of force values representing the pressure inside the dosing chamber from said force sensor; or a pressure sensor connected to the control device such that the control device receives one or more of pressure values representing the pressure inside the dosing chamber from said pressure sensor; or an electric drive signal connection from the electric drive to the control device to provide data representing the pressure inside the dosing chamber, wherein the control device includes a CPU, memory, software, a pressure sensor, and a position sensor, and the control device is configured to:

continuously record a position of the displacement element and at least one of the pressure inside the dosing chamber and the pressure related indicator as a curve in a pressure-stroke diagram;

monitor at least one characteristic portion of said curve in said pressure-stroke diagram to detect a shift of the at least one characteristic portion by comparing said characteristic portion of said curve of the pressure-stroke diagram over several strokes of the displacement element;

adjust a control of the electric drive based on the detected shift of the at least one characteristic portion; and determine a trend of the detected shift of the at least one characteristic portion and based on the determined trend determine whether the detected shift of the least one characteristic portion will reach a predefined limit and when a shift of the at least one characteristic portion will reach the predefined limit in the future;

calculate a predicted time period until failure based on the determination of when the detected shift of the least one characteristic portion will reach the predefined limit and at least one of:

output the calculated predicted time period until failure and/or output a warning; and switch off the dosing pump prior to reaching the predefined limit at the calculated predicted time period.

19. The dosing pump system according to claim 18, further comprising at least one of a display device connected to the control device and a communication device forming a part of the control device or connected to the control device, wherein the control device is configured to output the calculated predicted time period via the at least one of the display device and the communication device.

20. The dosing pump system according to claim 18, wherein the control device is configured to adjust a control of the electric drive based on the detected shift of the at least one characteristic portion such that a stroke pattern of the displacement element is changed to compensate a malfunction causing the detected shift of the at least one characteristic portion and to reduce the shift at least partly.

* * * * *